United States Patent [19]

Laskowski et al.

[11] 4,195,962

[45] Apr. 1, 1980

[54] PLATFORM LOADING SYSTEM

[75] Inventors: Gordon J. Laskowski, Port Orchard; Richard I. Schrick, Bremerton, both of Wash.

[73] Assignee: The United States of America as represented by the Secretary of the Navy, Washington, D.C.

[21] Appl. No.: 653,419

[22] Filed: Jan. 29, 1976

[51] Int. Cl.[2] ..... B65G 1/10

[52] U.S. Cl. ..... 414/659; 414/592; 414/660

[58] Field of Search ..... 214/16 CC, 15 R, 16 CD, 214/16 CE, 16 CF, 95; 414/595, 659, 660

[56] References Cited

U.S. PATENT DOCUMENTS

| | | | |
|---|---|---|---|
| 879,387 | 2/1908 | Ihlder | 214/95 R |
| 2,412,009 | 12/1946 | Rickland | 214/16.1 CE |
| 3,294,260 | 12/1966 | Frangos | 214/16.1 CE |
| 3,499,553 | 3/1970 | Stienen | 214/16.1 CE |
| 3,519,147 | 7/1970 | Walda | 214/16.4 R |

FOREIGN PATENT DOCUMENTS

| | | | |
|---|---|---|---|
| 653558 | 5/1963 | Italy | 214/16.1 CE |
| 660454 | 2/1964 | Italy | 214/16.1 CE |

*Primary Examiner*—Joseph F. Peters, Jr.
*Assistant Examiner*—Ross Weaver
*Attorney, Agent, or Firm*—R. S. Sciascia; Charles D. B. Curry

[57] ABSTRACT

A platform loading system having an elevator platform mounted loader unit and a magazine mounted loader unit in each magazine served by the loader system. Each loader unit consists of one cargo tray and its associated tray transfer machinery. In each loader unit a cargo tray may occupy one of two positions, an upper position or a lower position. The load to be transferred is always carried by a tray in the upper position. Transfer of weapons between elevator platforms and magazines consists of a simultaneous exchange of a loaded and empty tray between mating loader units. The loaded tray traveling in the upper position passes over the empty tray in the lower position heading in the opposite direction. At completion of tray exchange, loaded trays may be off-loaded and the now empty tray lowered to the lower tray position by a tray jacking system as required by the next exchange operation. Conversely, the empty tray in the lower position can be raised to the upper position and on-loaded if required by the next operation. The trays are flush with the deck and can be on or off-loaded by either overhead handling, wheeled dollies, fork lift trucks, or the like. Loader equipped elevator platforms with the tray in the upper position can be utilized as a conventional elevator platform in the event platform loader operation is not desired.

9 Claims, 15 Drawing Figures

PLATFORM LOADING SYSTEM

BACKGROUND OF THE INVENTION

1. Field of the Invention

The present invention relates to a cargo handling system and more particularly to a platform loading system where a loaded tray and an unloaded tray are simultaneously exchanged between the elevator loader unit and the deck loader unit.

2. Description of the Prior Art

The replenishment of the weapon stores of an aircraft carrier and the arming of its aircraft for a mission requires the movement of a large amount of cargo between topside and magazines below by elevators in a limited time. To improve the re-arming rate of aircraft carriers, methods of speeding up the flow of cargo on elevators has been required.

To reduce the non-productive elevator time required for loading and unloading, belt-type conveyor systems were developed to transfer a complete elevator load between magazine and elevator. These systems were complex, had gap and synchronization problems between elevator and magazine units, and stores could not be secured during the transfer.

The present invention overcomes these difficulties by providing a platform loader system that improves the time rate of transferring weapon cargos by elevators between decks on aircraft carriers. The platform loader system is a technique for automatically loading and unloading an elevator, thus reducing the standby time of the elevator and allowing it to carry more cargo in a given amount of time.

It is to be understood that the platform loader system of the present invention was primarily developed because of the need on aircraft carriers. However, it will be obvious to one skilled in the art that it may have very broad cargo handling applications and is not limited to use in elevator systems.

SUMMARY OF THE INVENTION

Briefly, the present invention comprises a platform loading system having an elevator platform mounted loader unit and a magazine mounted loader unit in each magazine served by the loader system. Each loader unit consists of one cargo tray and its associated tray transfer machinery. In each loader unit a cargo tray may occupy one of two positions, an upper position or a lower position. The load to be transferred is always carried by a tray in the upper position. Transfer of weapons between elevator platforms and magazines consists of a simultaneous exchange of a loaded and empty tray between mating loader units. The loaded tray traveling in the upper position passes over the empty tray in the lower position heading in the opposite direction. At completion of tray exchange, loaded trays may be off-loaded and the now empty tray lowered to the lower tray position by a tray jacking system as required by the next exchange operation. Conversely, the empty tray in the lower position can be raised to the upper position and on-loaded if required by the next operation. The trays are flush with the deck and can be on or off-loaded by either overhead handling, wheeled dollies, fork lift trucks, or the like. Loader equipped elevator platforms with the tray in the upper position can be utilized as a conventional elevator platform in the event platform loader operation is not desired.

OBJECTS OF THE INVENTION

An object of the present invention is to provide a rapid and effective cargo handling system.

Another object of the present invention is to provide a cargo handling system that may be used on elevators.

Still another object of the present invention is to provide a platform loading system that may be used on aircraft carrier elevator systems.

A further object of the present invention is to provide a platform loader system to increase cargo handling rate by minimizing the handling time and effort required to transfer cargo between the cargo area and the elevator platform.

Other objects, advantages and novel features of the invention will become apparent from the following detailed description of the invention when considered in conjunction with the accompanying drawings wherein:

DESCRIPTION OF THE PREFERRED EMBODIMENT

Figure 1:
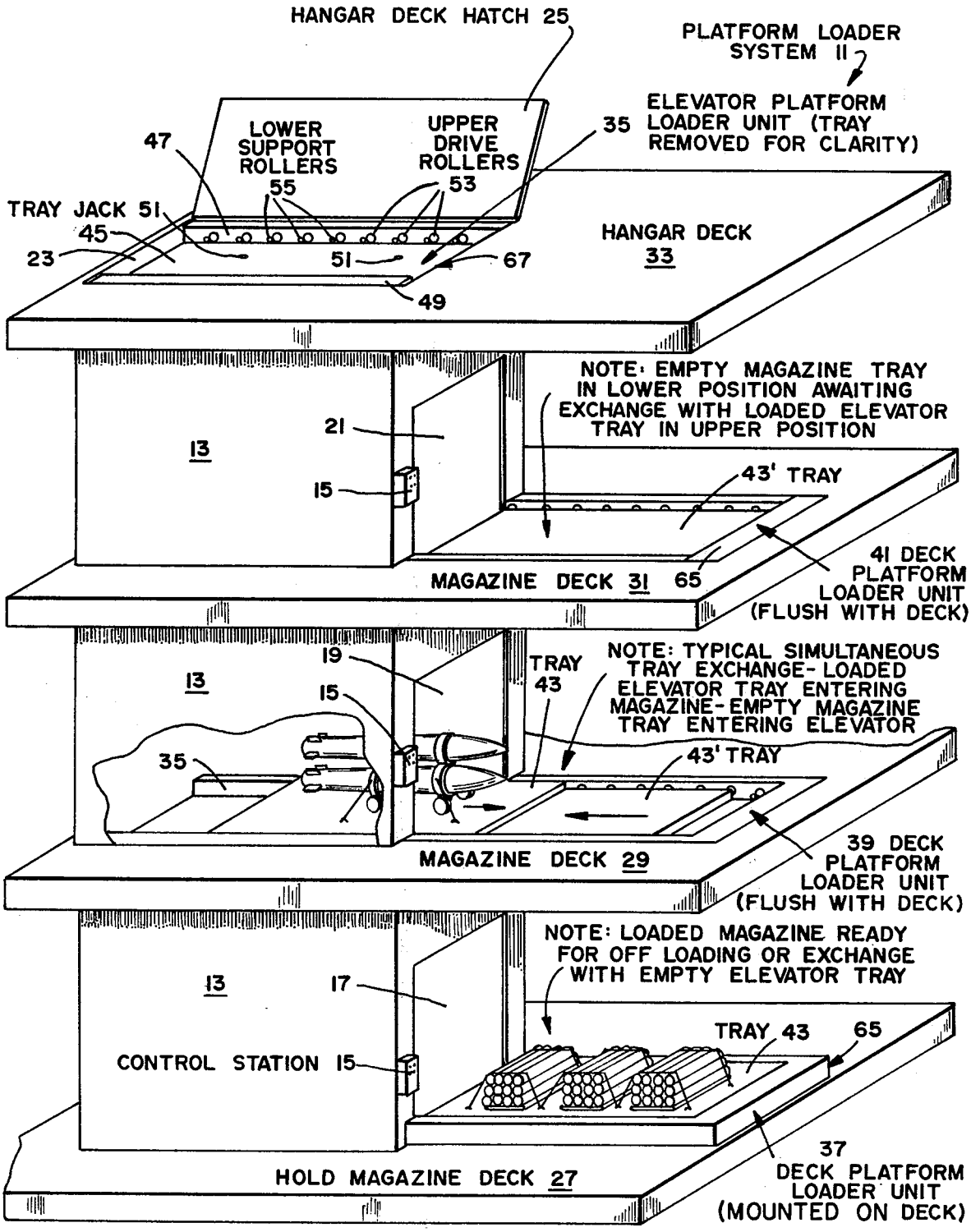
FIG. 1 is a pictorial view, partly in section, showing the platform loader system of the present invention being used with an elevator system for serving various cargo areas.

FIG. 1 is shown a pictorial view, partly in section, of the platform loader system 11 of the present invention. The platform loader system 11 is a weapon handling system designed to increase weapon handling rates by minimizing the handling time and effort required to transfer weapons between magazines and elevator platforms. In FIG. 1 the platform loader system 11 is illustrated as being used in conjunction with an elevator system that has an elevator platform, the various controls for the elevator platform, the elevator shaft through which the elevator platform travels, and the elevator shaft enclosure 13. In FIG. 1 is illustrated the elevator enclosure 13, the elevator control stations 15, the hold magazine vertical door 17, a magazine deck vertical open doorway 19, the magazine deck vertical door 21, and the hangar deck horizontal open doorway 23, and the hangar deck horizontal hatch or door 25, which is shown in the open position.

The platform loader system 11 is shown as serving four different positions, the hold magazine deck 27, magazine decks 29 and 31 and the hangar deck 33. The herein described platform loader system will be described in reference to a typical aircraft carrier elevator system; however, it is to be understood that the platform loader system of the present invention may be used for any elevator system, whether or not on board ships, such as aircraft carriers, or on land. It may be found useful any time that it is desirable to rapidly transfer the cargo from the elevator platform to the receiving area, such as the magazine deck, and to rapidly transfer the cargo from the receiving area to the elevator platform.

It should be noted that all of the deck platform loader units 37, 39 and 41 are identical and that the elevator platform loader unit 35 is very similar to the deck platform loader units 37, 39 and 41. In FIG. 1 the platform loader system 11 is shown as having two elevator platform loader units 35, one at magazine deck 29 and one at hangar deck 33. This is only done for purpose of illustration. In practice, the elevator system includes only a single elevator platform and on this single elevator platform is placed a single elevator platform loader unit 35. A plurality of deck platform loader units 37, 39 and 41 will be used, one at each deck, except at the hanger deck.

Referring to the overall operation of the system, the platform loader system 11 consists of an elevator platform loader unit 35, mounted on the elevator platform, and deck platform loader units 37, 39 or 41, mounted in or on the deck of each magazine served by the loader system 11. Each loader unit (35, 37, 39 or 41) consists of one cargo tray and its associated tray transfer machinery. In each loader unit the cargo tray may occupy one of two positions, an upper position or a lower position. The load to be transferred is always carried by the tray in the upper position. Transfer of weapons between elevator platforms and magazines consists of a simultaneous exchange of a loaded and empty tray between mating loader units. The loaded tray traveling in the upper position passes over the empty tray in the lower position heading in the opposite direction. At completion of tray exchange, loaded trays may be off-loaded and the now empty tray lowered to the lower tray position by a tray jacking system as hereinafter described and as required by the next exchange operation. Conversely, the empty tray in the lower position can be raised to the upper position and on-loaded if required by the next operation. The trays can be on or off-loaded by either overhead handling, wheeled dollies (when flush mounted), fork lift trucks, or the like. Loader equipped elevator platforms with the tray in the upper position can be utilized as a conventional elevator platform in the event platform loader operation is not desired.

Referring to FIG. 1, it can be seen that the deck platform loader unit, such as unit 37, may be mounted on the surface of the floor, as on magazine floor 27, or the deck platform loader unit, such as units 39 and 41, may be mounted flush with the floor, as with magazine decks 29 and 31. As hereinafter described, the upper cargo trays are referred to by reference numeral 43 and the lower cargo trays are referred to by reference numeral 43$^1$. In FIG. 1, deck unit 37 is shown with a loaded cargo tray 43 in the upper position ready to be transferred to the elevator unit 35 when it arrives at the hold magazine deck 27. On magazine deck 29, cargo is shown as being transferred from the upper cargo tray 43 of elevator loader unit 35 to the upper level of deck loader unit 39. Simultaneously, the empty lower tray 43$^1$ of the deck loader unit 39 is being transferred to the lower level of elevator loader unit 35. When cargo tray 43 has been transferred to the upper level of deck loader unit 39 the cargo is then ready to be removed. With tray 43$^1$ in the lower level of elevator loader unit 35, the upper level of elevator loader unit 35 is ready to receive a loaded tray from another deck loader unit, such as from deck loader unit 37 mounted on hold magazine deck 27.

Referring to magazine deck 31 the deck loader unit 41 is shown with tray 43$^1$ in the lower position awaiting exchange with an upper level loaded tray 43 from the elevator loader unit 35.

Referring to hangar deck 33 for reasons of clarity the elevator loader unit 35 is shown mounted on the elevator platform with the tray removed. It should be noted that on hangar deck 33 the cargo is directly unloaded from or loaded onto the flush upper cargo tray 43 (not shown) and no deck loader unit is used or is necessary.

As will be hereinafter described in detail the elevator loader unit 35 includes a lower base plate 45, a pair of spaced apart parallel frame assemblies 47 and 49, and four tray jacking units 51. The frame assemblies 47 and 49 are similar and include a plurality of upper friction drive rollers 53 and a plurality of lower support rollers 55.

Figure 2:
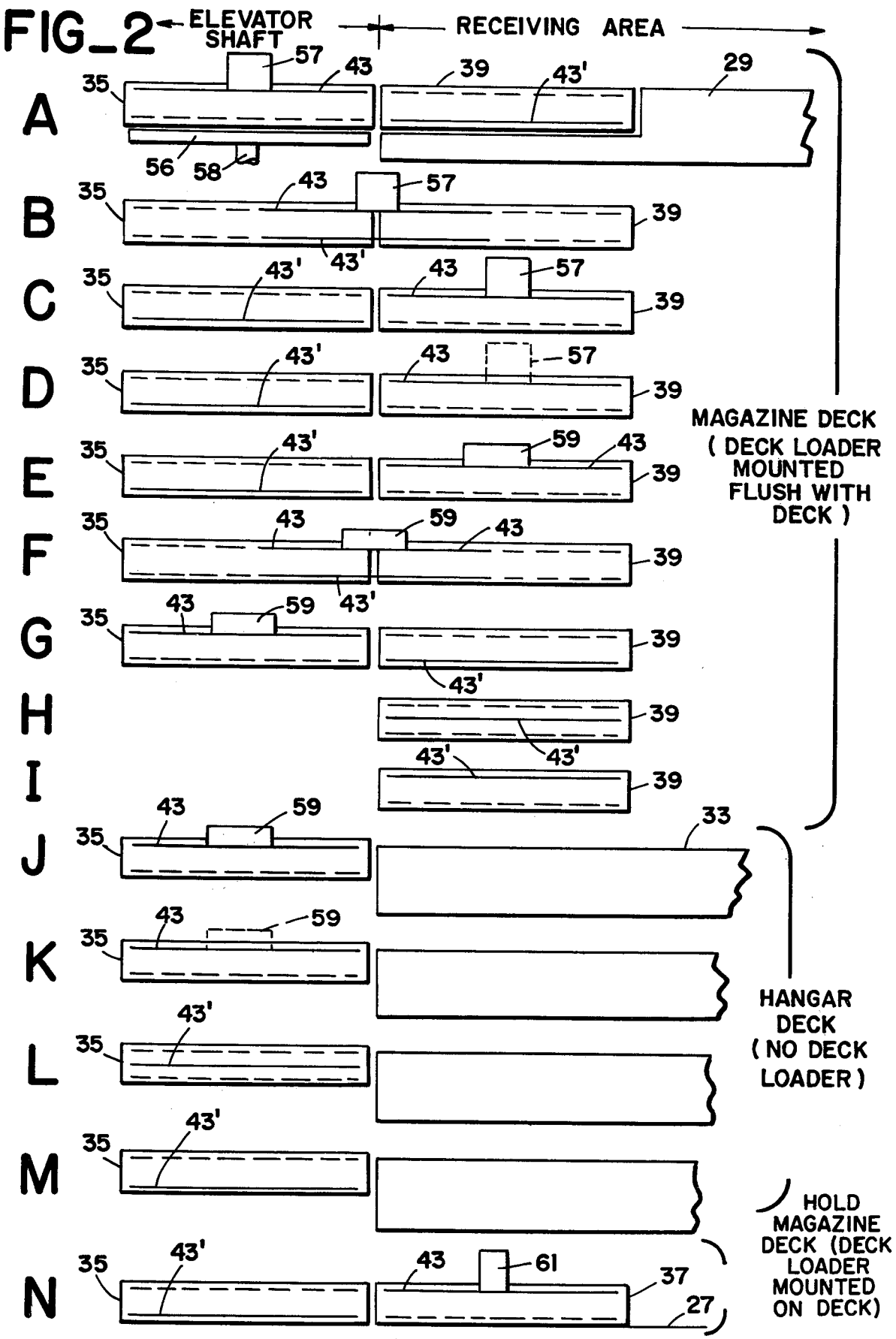
FIGS. 2A through 2N show the various sequences of tray positions between the elevator loader unit and the deck loader units of the platform loader system.

In FIGS. 2A through 2N is illustrated the system operation of the platform loader system 11 of the present invention. FIGS. 2A through 2I illustrate a typical sequence of events on the receiving area, such as magazine deck 29, between the elevator loader unit 35 and the deck loader unit 39. In the various Figures the two trays will be referred to as tray 43, when in the upper level, and tray 43$^1$, when in the lower level.

In FIG. 2A the cargo 57 is shown loaded on tray 43, positioned at the upper level of elevator loader unit 35. The elevator loader unit 35 is shown as being mounted on an elevator platform 56 that is raised and lowered by elevator lift shaft 58. Deck loader unit 39 is shown as being flush mounted with magazine deck 29 and has the tray 43$^1$ in the lower level. In FIG. 2B trays 43 and 43$^1$ are shown as simultaneously exchanging between elevator loader unit 35 and deck loader unit 39. In FIG. 2B the cargo 57 is being transferred from the elevator to the magazine deck. In FIG. 2C the trays 43 and 43$^1$ are shown as exchanged, with the cargo 57 at the upper level of deck loader unit 39. In FIG. 2D the cargo 57, shown in dotted lines, has been removed from tray 43 by conventional cargo handling means. In FIG. 2E, a different cargo 59 is loaded on upper tray 43 of deck loader unit 39. In FIG. 2F the trays 43 and 43$^1$ are shown as being exchanged between the elevator and magazine. In FIG. 2G the trays 43 and 43$^1$ have been exchanged and the cargo 59 may be then delivered by the elevator to another cargo receiving area, such as another magazine deck, the hold magazine deck or the hangar deck. Upon arrival at the new cargo receiving area the above described process may be repeated.

In FIG. 2G the tray $43^1$ is shown as being in the lower level of deck loading unit 39. In the event it is desirable to load this tray $43^1$ it is necessary to do so at the upper level. The platform loader system 11 of the present invention includes a jacking system that raises the tray from the lower position to the upper position as schematically illustrated in FIGS. 2H and 2I. The jacking operation will be hereinafter described in reference to FIGS. 3A, 3B, 3C and 3D.

In FIGS. 2J through 2M is illustrated the operation of the platform loader system 11 on the hangar deck 33. In this case the elevator loader unit 35, with upper tray 43 carrying cargo 59, for example, is flush with hangar deck 33. In FIG. 2K the cargo 59 is shown as being removed. The next event that must take place for elevator loader unit 35 is to receive a loaded tray at the upper level. It is therefore necessary to lower tray 43 from the upper level to the lower level as shown in FIGS. 2L and 2M.

In FIG. 2N the elevator loader unit 35 is shown ready to receive a cargo 61 from tray 43 of deck loader unit 37 located and resting on the surface of hold magazine 27 in a non-flush or elevated position. Cargo 61 would be then loaded onto the elevator in a manner similar to that shown in FIGS. 2E, 2F and 2G.

Figure 3A:
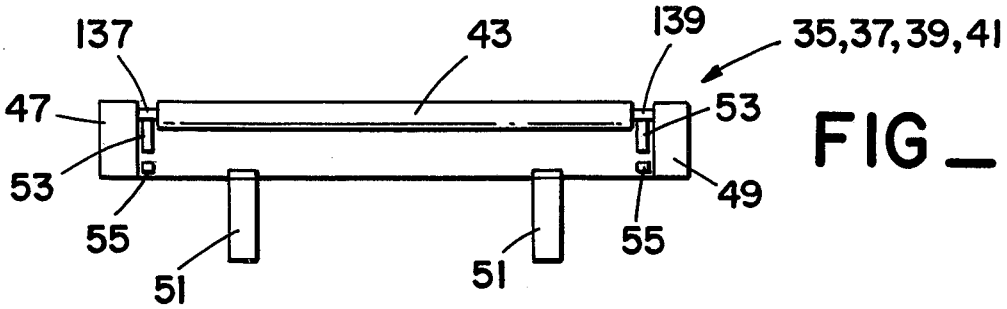
FIGS. 3A through 3D are a schematic illustration of the technique used to raise or lower a tray on the elevator loader unit and the deck loader unit of the present invention.
Figure 3B:
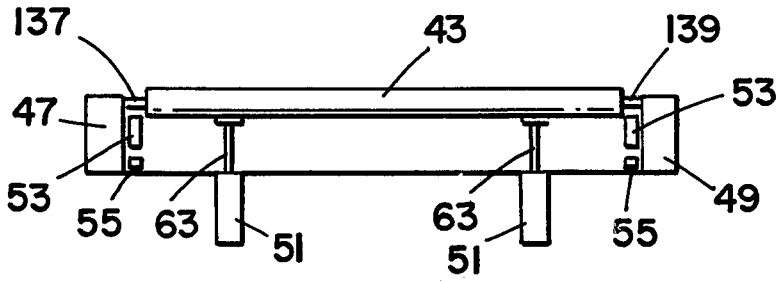
Figure 3C:
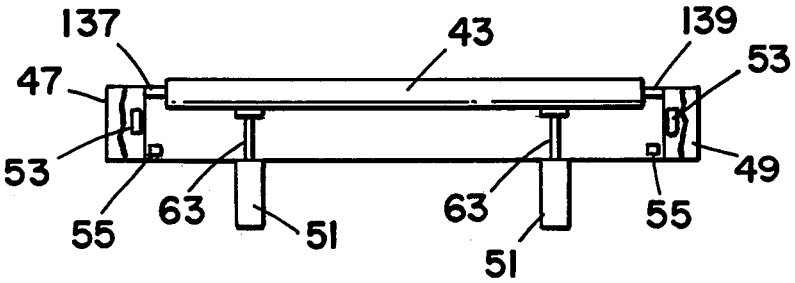
Figure 3D:
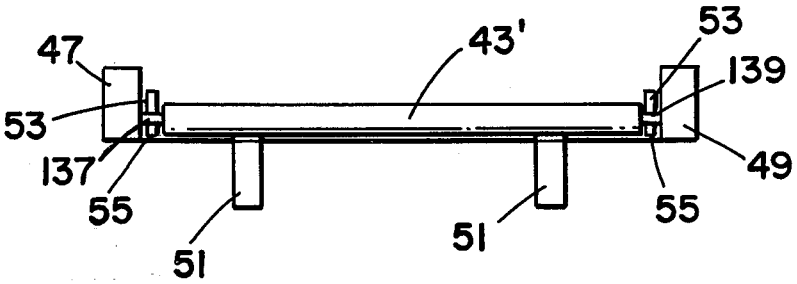

In FIGS. 3A through 3D are schematically illustrated the sequence of raising and lowering tray 43 in the elevator loader unit 35 and the deck loader units 37, 39 or 41. Each of these units includes a tray (43 in upper level or $43^1$ in lower level), a pair of spaced apart and parallel frame assemblies 47 and 49 and four tray jacking units 51 that include lifting elements 63. Each of the frame assemblies includes a plurality of horizontal spaced apart friction drive rollers 53 and a plurality of horizontal spaced apart lower support rollers 55 that are positioned below the drive rollers 53. Each of the trays includes a pair of horizontal spaced apart tapered edges 137 and 139 that extend the length of the tray. In FIG. 3A the tray 43 is shown at the upper level with edges 137 and 139, respectively, resting on the upper surface of friction drive rollers 53 of frame assemblies 47 and 49. When it is desired to lower tray 43 to the lower level, four tray jacking units 51 are simultaneously activated to raise lifting elements 63 so that they raise edges 137 and 139 of tray 43 off of drive rollers 53 as illustrated in FIG. 3B. Then drive rollers 53 are retracted into frame assemblies 47 and 49 as shown in FIG. 3C. After the drive rollers 53 are withdrawn, then lifting elements 63 of jacking units 51 are lowered and edges 137 and 139 of tray $43^1$ respectively rest on the upper surface of lower rollers 55 at the lower level and the drive rollers 53 are extended from frame assemblies 47 and 49 completing the sequence as shown in FIG. 3D. The lower support rollers 55 are biased upward so that the upper surface of tray edges 137 and 139 are in contact with the lower surface of friction drive rollers 53. The jack control system employs a load sensor so that the upper tray cannot be actuated by the jack system if it is loaded by more than a predetermined amount, for example, 2000 pounds. This override control is employed so that a loaded tray will not be inadverently lowered to the lower level of the elevator or deck loader units. When it is desired to raise the tray from the lower level to the upper level the above described sequence is reversed.

Figure 4:
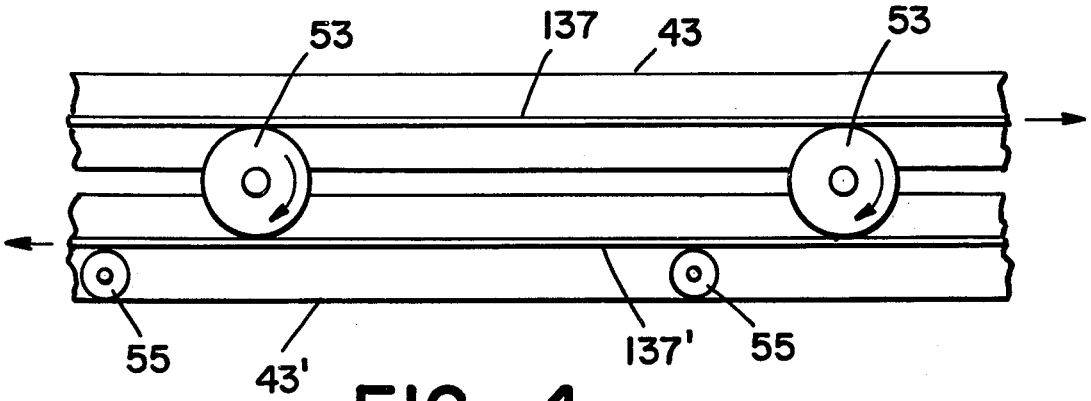
FIG. 4 is a schematic diagram illustrating the function of the friction drive rollers used in the platform loader system.

In FIG. 4 is schematically shown the functional operation of drive rollers 53. In FIG. 4 the drive rollers 53 all rotate clockwise, or counterclockwise, depending upon the direction of travel desired for the upper or lower trays. The lower surface of edge 137 of the upper tray 43 rests against the upper surface of friction drive rollers 53, which are made of elastomeric material, and therefore moves to the right when drive rollers 53 are rotating clockwise. The upper surface of edge $137^1$ of lower tray $43^1$ is biased against the lower surface of friction drive rollers 53 by an upward spring bias imparted to lower rollers 55, and the lower tray moves to the left when the drive rollers 53 are rotating clockwise. The particular mechanisms for achieving these functions will be hereinafter described in detail.

Figure 5:
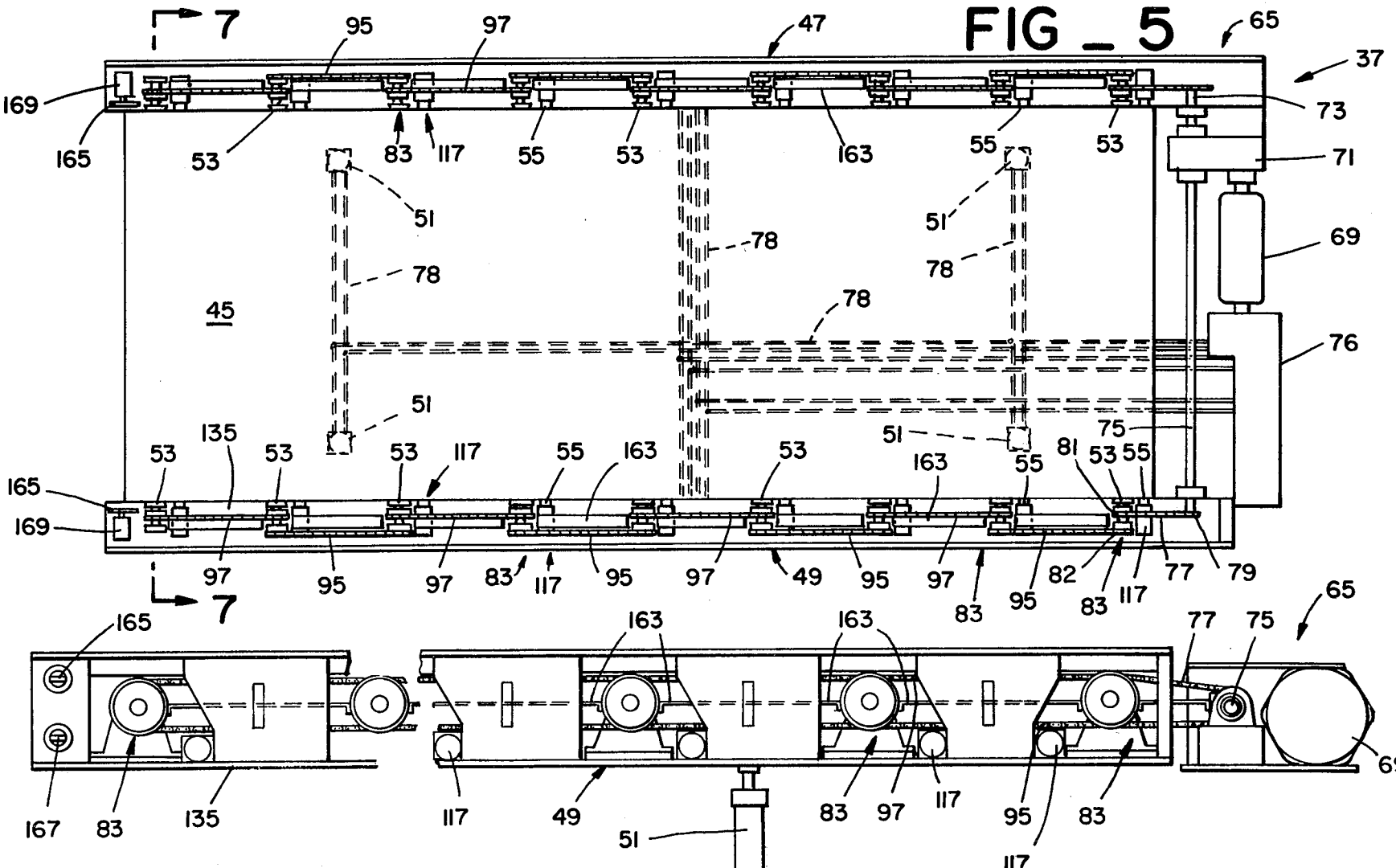
FIG. 5 is a top elevation drawing, partly in section, showing the details of the deck loader unit; all deck loader units are the same and the elevator loader unit is very similar and is therefore not shown.
Figure 6:
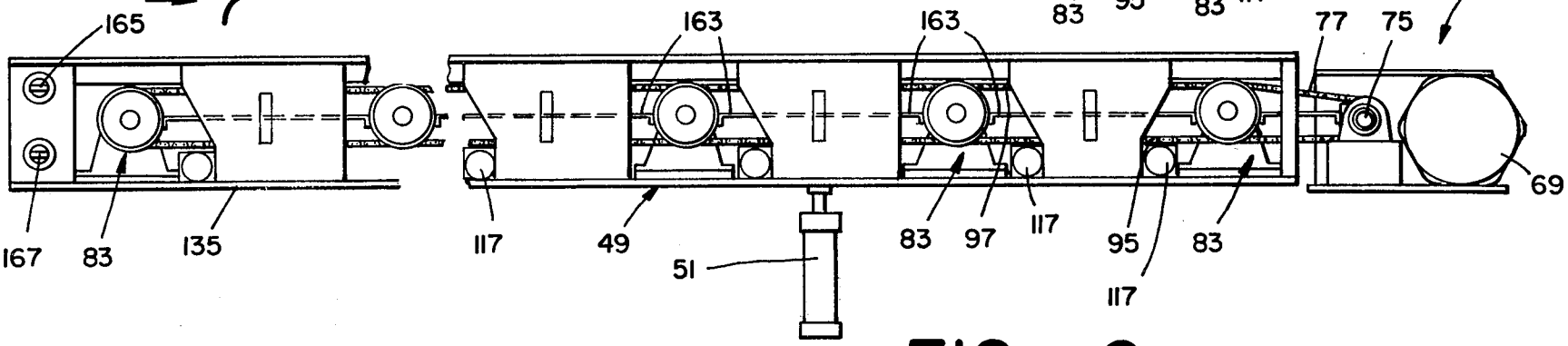
FIG. 6 is an enlarged side elevation, partly in section, of the deck loader unit shown in FIG. 5.

In FIG. 5 is illustrated a top elevation schematic drawing, partly in section, illustrating the details of one of the deck loader units such as deck loader unit 37, for example. In FIG. 6 is illustrated an enlarged side elevation, partly in section, of the FIG. 5 deck loader unit 37. It is to be understood that all deck loader units will be built the same and that the elevator loader unit 35 will have virtually all the same mechanical features except for a few obvious changes which are brought about because the elevator loader unit and the deck loading unit always face each other and therefore the various elements will be operating in reverse directions in order to operate properly. Another difference between the elevator loader unit 35 and the deck loader unit 37 is the positioning of the motor and the drive system. Referring to FIGS. 1, 5 and 6, deck loader unit 37 will include the motor and drive mechanism in the rearward section 65, since horizontal space is not a limiting factor. However, in the elevator loader unit 35, the motor and drive mechanism will be beneath the forward section as generally denoted by the reference numeral 67 in the drawing associated with the elevator loader unit 35 of FIG. 1. It should be noted that this is done because lateral space is quite limited in the elevator and the mating edges of the elevator loader unit and the deck loader unit must not have interference from the motor or drive mechanism and the various drive and support elements. That is, in order to provide proper transition and exchange of trays the mating edges of the loader and elevator units must be in close proximity.

Figure 7:
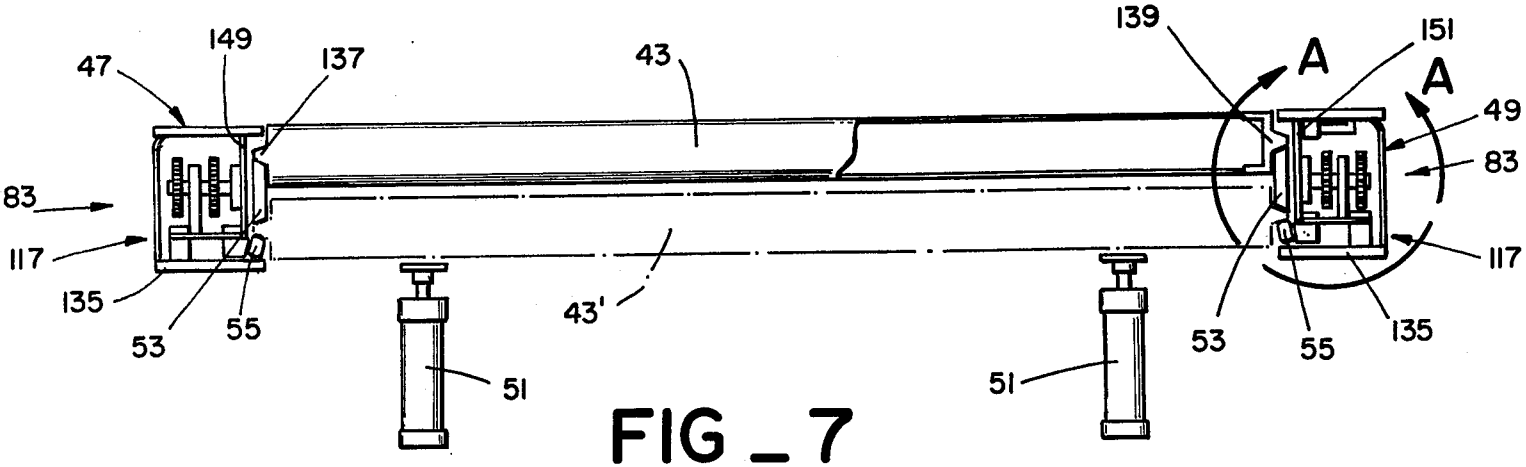
FIG. 7 is a front elevation, partly in section, of the deck loader unit shown in FIGS. 5 and 6.

Referring to FIGS. 5, 6 and 7 the overall characteristics of the deck loader unit 37 are selected such that the length is about 19 feet (the elevator unit is about $17\frac{1}{2}$ feet), the width is about 8 feet, the height is about 12 inches, the jack height is about 14 inches, and the weight is about 7,000 pounds. The overall characteristics of each tray are selected such that the length is about 17 feet, the width about $6\frac{1}{2}$ feet, the height about 4 inches and the weight about 2,000 pounds. It has been found that each unit may be effectively operated by a 2 horsepower motor and the hydraulic actuator system is preferably pneumatic. The various switches and control elements are preferably of the relay logic type. The control system will not be described since its design will be obvious to one skilled in the art in view of the previous and following descriptions of the mechanical elements and their functions and operation.

In FIGS. 5, 6, 7 and 8 the deck loader unit includes a total of 18 friction drive rollers 53. These friction drive rollers 53 are driven by a chain and sprocket system that is contained in each of the parallel spaced apart frame assemblies 47 and 49. The power for driving the chain and sprocket systems of frame assemblies 47 and 49 is obtained from rearward section 65. Rearward section 65 includes electric motor 69, gear box 71, drive shafts 73 and 75. Drive shaft 73 drives the chain and sprocket system of frame assembly 47 and drive shaft 75 drives the chain and sprocket system of frame assembly 49. Rearward section 65 also includes hydraulic power system, generally identified by reference numeral 76. The hydraulic power system is driven by motor 69 and transmits hydraulic fluid to the various hydraulically driven units by means of conduits, shown in dotted lines and generally identified by reference numeral 78. It is to be understood that this hydraulic power system is considered to be conventional and will therefore not be described in detail.

Only frame assembly 49 will be described since frame assembly 47 is a mirror image but identical in construction and operation. Frame assembly 49 includes a plurality of sprocket and drive roller assemblies 83 (including a plurality of friction drive rollers 53), a plurality of bias and support roller assemblies 117 (including lower bias and support rollers 55), a plurality of outer chains 95, and a plurality of center chains 97. Only single elements of frame assembly 49 will be described since the various elements are repeating and identical throughout its length. Frame assembly 49 receives its input power from chain 77 which is driven by sliding sprocket 79, which is connected to drive shaft 75. Chain 77 provides power to sprocket 81 of sprocket and drive roller assembly 83. As will be hereinafter explained in detail (see FIGS. 8 and 9) roller 53, sprocket 81 and sprocket 82 are connected together and are rotatably mounted in sprocket and drive roller assembly 83. Outer chain 95 interconnects sprocket 82 of the initial assembly 83 to sprocket 82 of the next adjacent assembly 83. Center chains 97 interconnect adjacent sprockets 81 as best shown in FIG. 5. Therefore, when chain 77 rotates the drive roller 53 of the initial assembly 83, the drive rollers 53 of the remaining assemblies 83 are rotated by means of the interconnecting chains 95 and 97.

Figure 8:
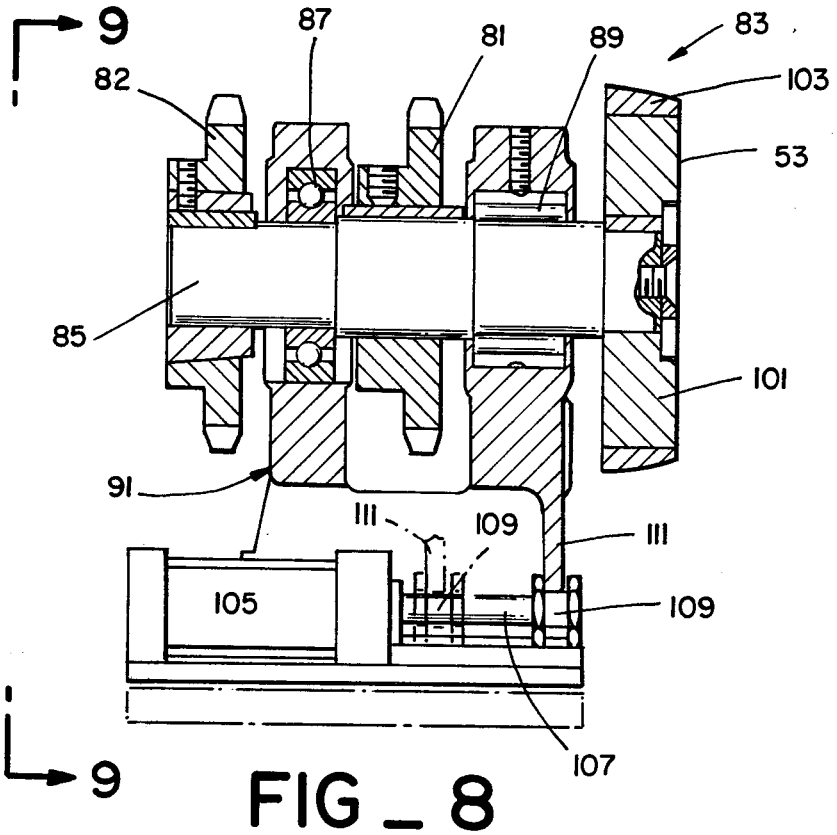
FIG. 8 is a cross-sectional view of the sprocket and drive wheel assembly of the deck loader unit of FIG. 5.
Figure 9:
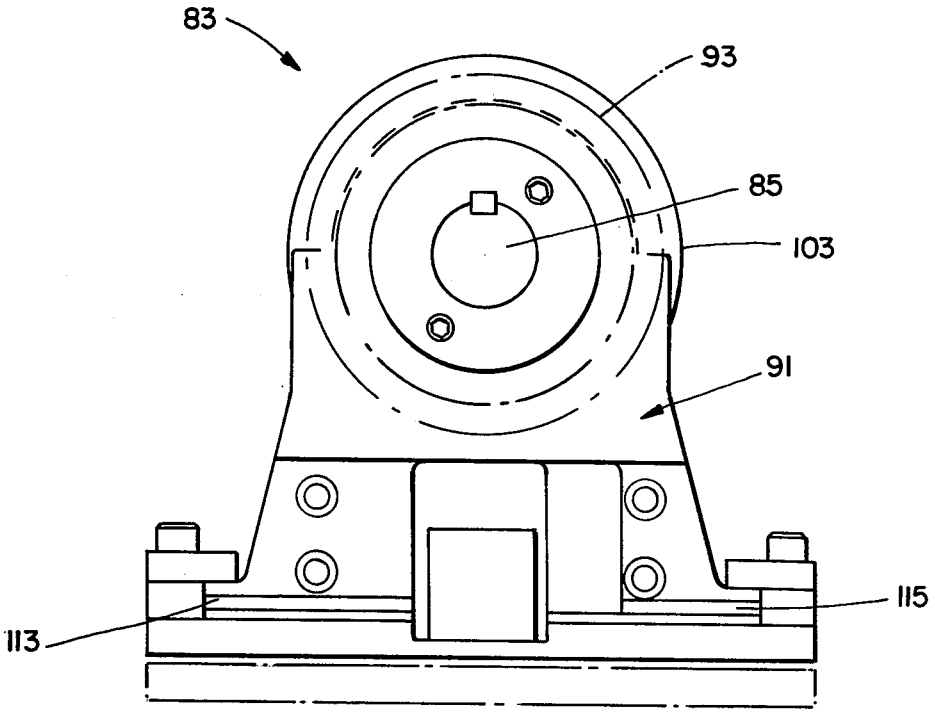
FIG. 9 is an end view of the sprocket and drive wheel assembly of FIG. 8.

As best shown in FIGS. 8 and 9 sprocket 81 is rigidly connected to shaft 85. Shaft 85 is rotatably mounted on bearings 87 and ,89 that are supported by frame 91. Sprocket 82 and friction drive roller 53 are also rigidly connected to shaft 85. Drive roller 53 preferably has a metal interior section 101 and a beveled exterior section 103 that is made of elastomeric material that is rigidly bonded to the periphery of interior section 101. All of sprocket and drive wheel assemblies 83 are movable in the lateral direction or in a direction that is parallel to the longitudinal axis or shaft 85. This is achieved by actuator 105 that positions rod 107 in the fully extended position, as shown by solid lines in FIG. 8, or in the fully withdrawn position, as shown by dotted lines in FIG. 8. The end of rod 107 has a collar 109 that locks arm 111 to the collar. Arm 111 is connected to frame 91 and will therefore move the entire sprocket and drive wheel assembly 83 to the retracted or extended positions along rails 113 and 115 as best shown in FIG. 9.

Figure 10:
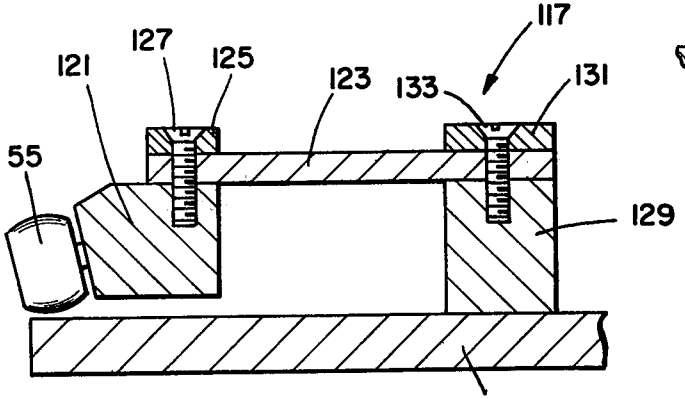
FIG. 10 is a sectional diagram illustrating the bias roller assembly used in the deck loader unit of FIG. 5.

Referring to FIGS. 5, 6, 7, 7A and 10, each of frame assemblies 47 and 49 includes a plurality (18 are illustrated) of bias roller assemblies 117. Referring to FIG. 10, each bias roller assembly 117 includes a metal bias roller 55 that is rotatably mounted on support block 121. Support block 121 is mounted on one end of bias leaf spring 123 by an upper plate 125 and screw 127. The other end of leaf spring 123 is rigidly mounted on support block 129 by means of upper plate 131 and screw 133. Support block 129 is mounted on the base 135 of frame assembly 49.

Figure 7A:
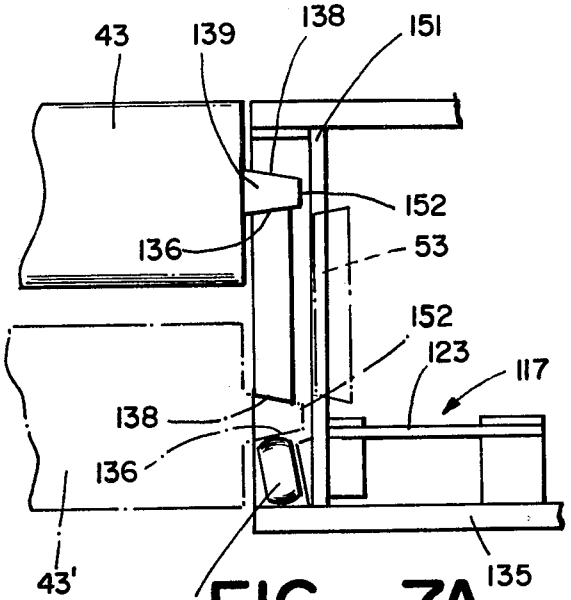
FIG. 7A is an enlarged sectional view taken at section A—A of FIG. 7.

From FIGS. 7 and 7A it can be seen that tray 43 includes a pair of support rails 137 and 139. Each support rail includes a lower tapered edge 136 and an upper tapered edge 138. When the tray 43 is in the upper level the lower tapered edges 136 of the rails are supported on the upper surface of friction drive rollers 53 of frame assemblies 47 and 49 while the upper tapered edges 138 are unsupported. When the tray 43 is in the lower level, as indicated by the dotted lines of FIGS. 7 and 7A, then the lower tapered edges 136 of tray 43 rest against steel bias rollers 55 which bias the tray upward so that upper tapered edges 138 are forced against friction drive rollers 53 in frame assemblies 47 and 49.

Figure 11:
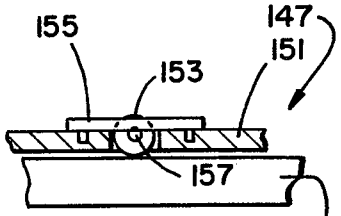
FIG. 11 is a top elevation, partly in section, of the guide roller assembly used in the deck loader unit of FIG. 5.

A plurality of guide roller assemblies 147, the details of which are shown in FIG. 11, are attached to plates 149 and 151 of frame assemblies 47 and 49, respectfully, at a plurality of positions that are opposite the outer edge 152 of support rails 137 and 139. Each of the guide roller assemblies 147 includes a steel roller 153 and a retaining plate 155 for retaining the axial shaft 157 in position. Openings are provided in retaining plate 155 and plates 149 and 151 to allow the guide roller 153 to rotate. The periphery of the guide rollers 153 will abut the outer edges 152 of rails 137 and 139 and therefore restrain the trays from lateral motion but allow longitudinal motion during the exchange of trays.

Referring to FIGS. 5 and 6, each of the sprocket and drive wheel assemblies 83 are preferably structurally interconnected by steel tie plates 163. These steel tie plates 163 are used to assure proper lateral motion of all of sprocket and drive wheel assemblies 83 in the event that one or more of the actuators 105 (see FIG. 8) does not operate properly. If the actuator 105 does not operate properly for one assembly 83, that assembly will still be actuated and slide in its tracks 113 and 115 (see FIG. 9) since the adjacent tie plates 163 will be actuated by the adjacent assemblies 83.

As generally indicated in FIGS. 5 and 6, a pair of stops 165 and 167 are provided at the discharge end of frame assemblies 47 and 49. These stops are forward biased by actuaters 169 to lock the trays 43 in place. Stops 165 and 167 must be withdrawn by actuators 169 to permit lateral movements of trays in either the upper or lower positions.

The only difference between the elevator and deck loader units is in the positioning of the motor 69, gear box 71 and the associated drive assemblies. In the elevator units these elements are positioned underneath the end of the elevator loader unit rather than extending beyond the end as in the case of the deck loader units the details of which are shown in FIGS. 5 and 6.

Other modifications of the loader system of the present invention will be obvious to those skilled in the art and are intended to be encompassed by the present disclosure provided they are compatible with the above described teachings. For example, loader units could be double ended, exchanging trays at either end, various other means could be employed to drive the trays and to lift them between upper and lower positions. The drive rollers could be driven by individual electric, air or hydraulic motors. The rollers could be left unpowered and the trays pushed or pulled by a system of air or hydraulic cylinders. Linear electric motors could be used to drive various elements. A system of mechanical levers and linkages could also be used.

What is claimed is:

1. A cargo handling system comprising:

(a) a first loader unit;

(b) a second loader unit;

(c) said first loader unit having first means for supporting a tray at an upper level and second means for supporting a tray at a lower level;

(d) said first loader unit including first raising and lowering means for selectively lowering a tray from said upper level to said lower level or for raising a tray from said lower level to said upper level;

(e) said second loader unit having third means for supporting a tray at an upper level and fourth means for supporting a tray at a lower level;

(f) said second loader unit including a second raising and lowering means for selectively raising a tray from said lower level to said upper level or for lowering a tray from said upper level to said lower level;

(g) transfer means for selectively transferring a first tray from said upper level of said first loader unit to said upper level of said second loader unit and transferring a second tray from said lower level of said second loader unit to said lower level of said first loader unit or transferring a first tray from said lower level of said first loader unit to said lower level of said second loader unit and transferring a second tray from said upper level of said second loader unit to said upper level of said first loader unit whereby said transfer means simultaneously transfers said first and second trays.

2. The system of claim 1 wherein:

(a) said first and third means comprise a plurality of friction drive rollers; and (b) said second and fourth means comprising a plurality of bias rollers.

3. The device of claim 2 wherein:

(a) said transfer means includes drive means for rotating said plurality of friction drive rollers; and (b) said bias rollers simultaneously support each of said trays and bias each of said trays against said friction drive rollers.

4. The system of claim 2 wherein:

(a) said first loader unit includes first and second frame assemblies;

(b) said first frame assembly being about parallel to and spaced from said second frame assembly;

(c) said plurality of said friction drive rollers being spaced apart and mounted in longitudinal alignment on said first frame assembly;

(d) said plurality of said friction drive rollers being spaced apart and mounted in longitudinal alignment on said second frame assembly;

(e) said plurality of said bias rollers being spaced apart and mounted in longitudinal alignment on said first frame assembly; and (f) said plurality of said bias rollers being spaced apart and mounted in longitudinal alignment on said second frame assembly.

5. The system of claim 4 wherein:

(a) said plurality of friction drive rollers on said first frame assembly are positioned above said bias rollers mounted on said first frame assembly; and (b) said plurality of friction drive rollers on said second frame assembly are positioned above said bias rollers mounted on said second frame assembly.

6. The device of claim 5 wherein:

(a) said friction drive rollers support and drive said upper tray; and (b) said spring bias rollers support said lower tray and said friction drive rollers drive said lower tray.

7. The system of claim 6 including:

(a) actuating means for simultaneously moving said friction drive rollers on said first frame assembly and said friction drive rollers on said second frame assembly in opposite and in transverse directions with respect to the longitudinal axis of said first and second frame assemblies.

8. The system of claim 7 including:

(a) jack means for raising or lowering said tray when said friction drive rollers on said first and second frame assemblies have been withdrawn.

9. The device of claim 1 wherein:

(a) each of said raising and lowering means including actuating means for selectively withdrawing or extending said first and third means to permit raising and lowering of said trays and jack means for raising or lowering said trays when said first and third means are withdrawn.

* * * * *